US005094449A

United States Patent [19]

Stearns

[11] Patent Number: 5,094,449

[45] Date of Patent: Mar. 10, 1992

[54] EXERCISE APPARATUS FOR ABDOMINAL EXERCISES

[76] Inventor: Kenneth W. Stearns, P.O. Box 55912, Houston, Tex. 77252

[21] Appl. No.: 563,930

[22] Filed: Aug. 7, 1990

[51] Int. Cl.[5] ..... A63B 23/02; A63B 21/062

[52] U.S. Cl. ..... 272/134; 272/118

[58] Field of Search ..... 272/94, 96, 117, 118, 272/130, 132, 134, 125, 144; 128/25 R

[56] References Cited

U.S. PATENT DOCUMENTS

| | | | |
|---|---|---|---|
| 3,544,103 | 12/1970 | Conable | 272/134 |
| 4,349,193 | 9/1982 | Lambert, Jr. et al. | 272/118 |
| 4,452,447 | 6/1984 | Lepley et al. | 272/130 X |
| 4,456,245 | 6/1984 | Baldwin | 272/118 |
| 4,511,137 | 4/1985 | Jones | 272/118 |
| 4,563,003 | 1/1986 | Bugallo et al. | 272/118 |
| 4,603,855 | 8/1986 | Sebelle | 272/117 |
| 4,629,185 | 12/1986 | Amann | 272/134 X |
| 4,653,750 | 3/1987 | McIntyre | 272/134 |
| 4,678,186 | 7/1987 | McIntyre et al. | 272/134 |
| 4,721,303 | 1/1988 | Fitzpatrick | 272/117 |
| 4,732,381 | 3/1988 | Skowronski | 272/134 |
| 4,733,859 | 3/1988 | Kock et al. | 272/94 X |
| 4,733,860 | 3/1988 | Steffee | 272/134 |
| 4,768,779 | 9/1988 | Oehman, Jr. et al. | 272/134 X |
| 4,802,462 | 2/1989 | Reiss et al. | 272/134 X |
| 4,949,951 | 8/1990 | Deola | 272/134 |
| 4,986,538 | 1/1991 | Ish, III | 272/134 |
| 4,989,859 | 2/1991 | Jones | 272/134 X |

OTHER PUBLICATIONS

Advertisement for "The Roughneck", In Coach & Athlete, Nov. 1981, p. 27, 272/94.

*Primary Examiner*—Robert Bahr

*Attorney, Agent, or Firm*—Dodge, Bush, Moseley & Riddle

[57] ABSTRACT

An exercise apparatus (10) particularly for developing and conditioning abdominal muscle group of the torso of a user while seated on a fixed seat (36) of a fixed frame (13). Three separate movable frames, called a crunch frame, a sway frame, and a twist frame are provided to allow the user to individually or simultaneously exercise abdominal muscles while crunching (bending forward), swaying (bending from side-to-side), or twisting (rotating his torso). Variable resistance to the movement of the frames is provided by weights (22) and pulleys (20, 80, 82, 84A, 84B, 86A, 86B, 88, 90, 92A, 92B, 94A, 94B, 96A, 96B) operatively connected by a cable (26) to the crunch frame, sway frame, and twist frame.

16 Claims, 5 Drawing Sheets

20
26
24
22
80
26
16
17A
34
67
67
344
346
322
330
96A
96B
324
340
342
312
202
320
314
302
266
302
276
40
38
274
272
36
49
45
53
52
13
28
34

EXERCISE APPARATUS FOR ABDOMINAL EXERCISES

BACKGROUND OF THE INVENTION

1. Field Of The Invention

This invention relates to exercise apparatus for abdominal exercises while a user is in an upright seated position, and more particularly to such exercise apparatus permitting a plurality of different movements for the torso of the user for exercising various abdominal muscles.

2. Description Of Prior Art

Heretofore, exercise apparatus has been provided for exercising the abdominal muscles of a human torso while a user is seated on the apparatus. For example, U.S. Pat. No. 4,733,860 dated Mar. 29, 1988 discloses a rotary torso exercise machine or apparatus particularly for the upper torso of a user with a user locking his or her elbows around side bars and rotating the upper torso relative to the lower torso. U.S. Pat. No. 4,349,193 shows an exercise machine for exercising the abdominal muscles in a torso with the user gripping overhead handgrips and then moving in a rotary motion. Thus, the prior art illustrates the performance of a body exercise for a particular muscle or group of muscles in the abdominal area of a torso.

It is important for participants in many sports to have strong abdominal muscles and it is desirable to be able to isolate a particular muscle for exercise and/or development. Further, it is desirable to be able to exercise several abdominal muscle groups simultaneously or separately as selected.

SUMMARY OF THE INVENTION

The present invention is particularly directed to exercise apparatus for abdominal muscles which permits the exercising of at least two different abdominal muscle groups, either simultaneously or separately as desired. The abdominal muscles include three separate muscle groups comprising (1) the rectus abdominous, (2) the inner oblique, and (3) the outer oblique. Strong abdominal muscles are important to a person while participating in many sports. Also many people want a lean torso which is an indication of fitness and conditioning. It is normally necessary to exercise the abdominal muscles, and preferably all three muscle groups to achieve a lean, muscular torso. Dependent on the particular muscle groups requiring conditioning and/or development, simultaneous or independent exercising of the muscle groups may be selected by the exercise apparatus of the present invention.

A human torso is capable of movement in three separate planes about three distinct axes. The present invention generally duplicates the movements of the upper torso in three separate planes about three distinct axes relative to the lower torso of the user seated in an upright position on a fixed seat. Further, the exercise apparatus of the present invention permits a user to isolate a desired movement of a desired combination of movements. The three separate movements of the upper torso from a seated position on the exercise apparatus include (1) a downward bending or so-called "crunch" movement about a side-to-side horizontal axis through his torso, (2) a rotary movement or "twist" of the upper torso about a generally vertical axis, and (3) a side bending or "swaying" movement of the upper torso about a front-to-back horizontal axis through his torso. The exercise apparatus of the invention uses three movable separate frames pivotably mounted to each other for duplicating the movements of the upper torso with resistance means providing a force resisting each of the pivoted movements.

It is an object of this invention to provide an exercise apparatus for abdominal exercise while a user is in a seated upright position on a fixed seat.

It is a further object of the invention to provide such an exercise apparatus which is adapted for exercising at least two different abdominal muscle groups either simultaneously or separately.

Another object of the invention is to provide an exercise apparatus which includes three movable frames pivotably mounted to each other with each frame simulating a movement of the upper torso of a user and having a variable force resisting the pivotal movements of the frames.

Other objects, features, and advantages of this invention will become more apparent after referring to the following specification and drawings.

DESCRIPTION OF THE PREFERRED EMBODIMENT OF THE INVENTION

Figure 1:
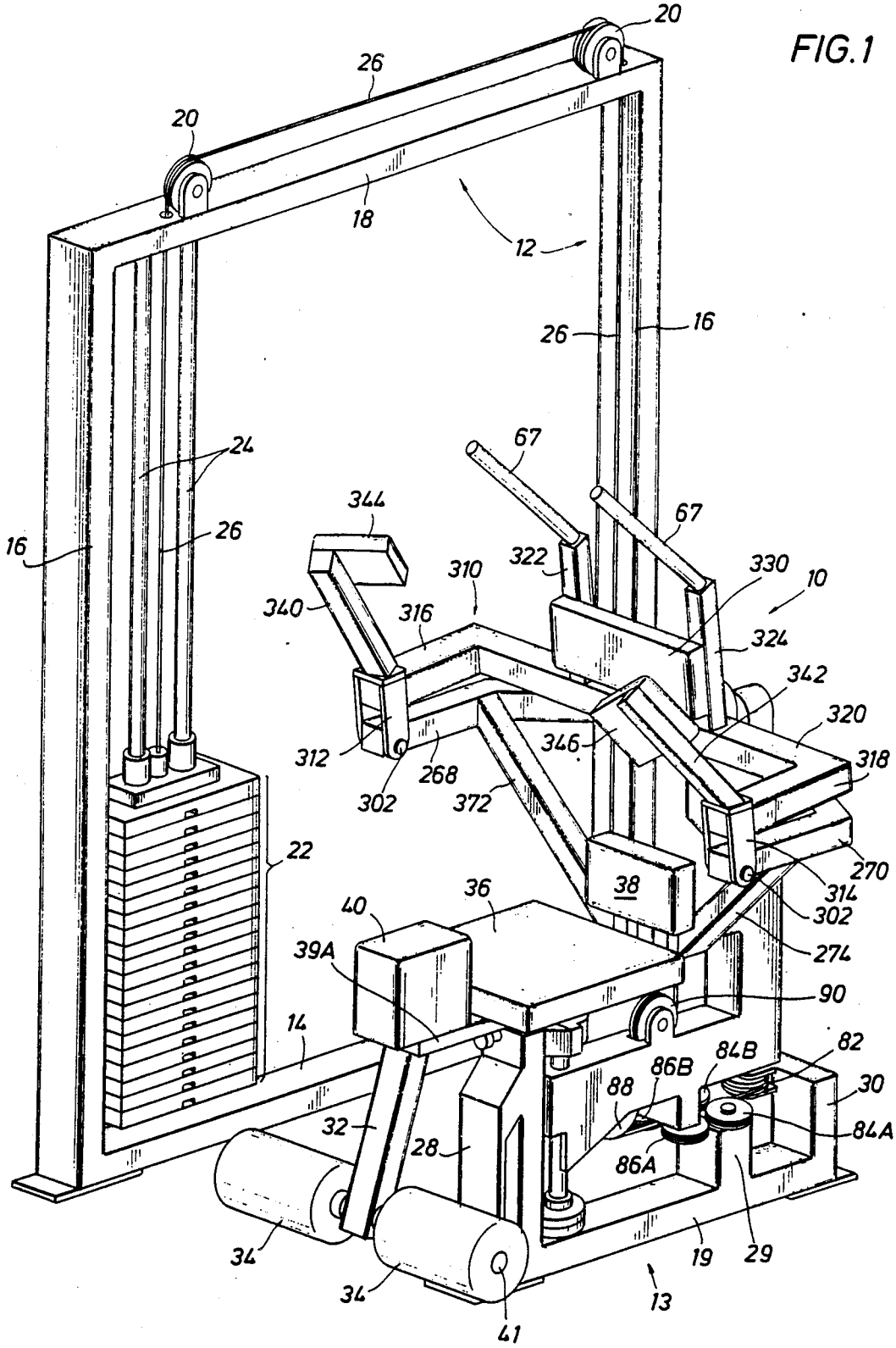
FIG. 1 is a front perspective of the exercise apparatus comprising the present invention including a main fixed frame having a seat for the user and three separate movable frames pivotally mounted to each other adjacent the fixed frame for simulating torso movements with the three movable frames being shown in a centered rest relation.

Referring now to the drawings for a better understanding of the invention, the exercise apparatus is generally indicated at 10 and includes a weight stand generally indicated at 12 having a horizontal base frame member 14 supported on a floor or other supporting surface.

Rotation stand 13 includes a horizontal base frame member 19. As best seen in the top view of FIG. 4, weight stand 12 and rotation stand 13 are connected to each other by horizontal cross members 17A, 17B.

Weight stand 12 includes a pair of generally vertically extending fixed members 16 extending upwardly from base frame member 14 and connected to each other by an upper horizontally extending frame member 18. Upper horizontal frame member 18 includes pulleys 20 mounted for rotation thereon. A plurality of weights 22 are mounted for sliding movement along spaced vertical rods 24 secured to weight frame 12. A cable 26 connected to weights 22 extends about pulleys 20 for providing a variable resistance to the various movements of the exercise apparatus as will be explained further hereinafter.

Rotation assembly stand 13 includes front and rear vertical members 28, 30 extending upwardly from base member 19. Intermediate vertical member 29 also extends upwardly from base member 19.

As best illustrated in FIGS. 1, 2, 3, and 4, the exercise apparatus includes a seat 36 which may be fixed at various angular positions with respect to supporting member 39 which includes a vertical member 39B and a horizontal member 39A. Lower seat back 38 is fixed to vertical member 39B. A leg divider 40 is mounted on horizontal member 39A forward of seat 36. A support 32 is attached to horizontal member 39A and extends in a downward and forward angle therefrom and is terminated by a shaft 41 on which right and left rotatable foot rests or supports 34 are provided.

Figure 2:
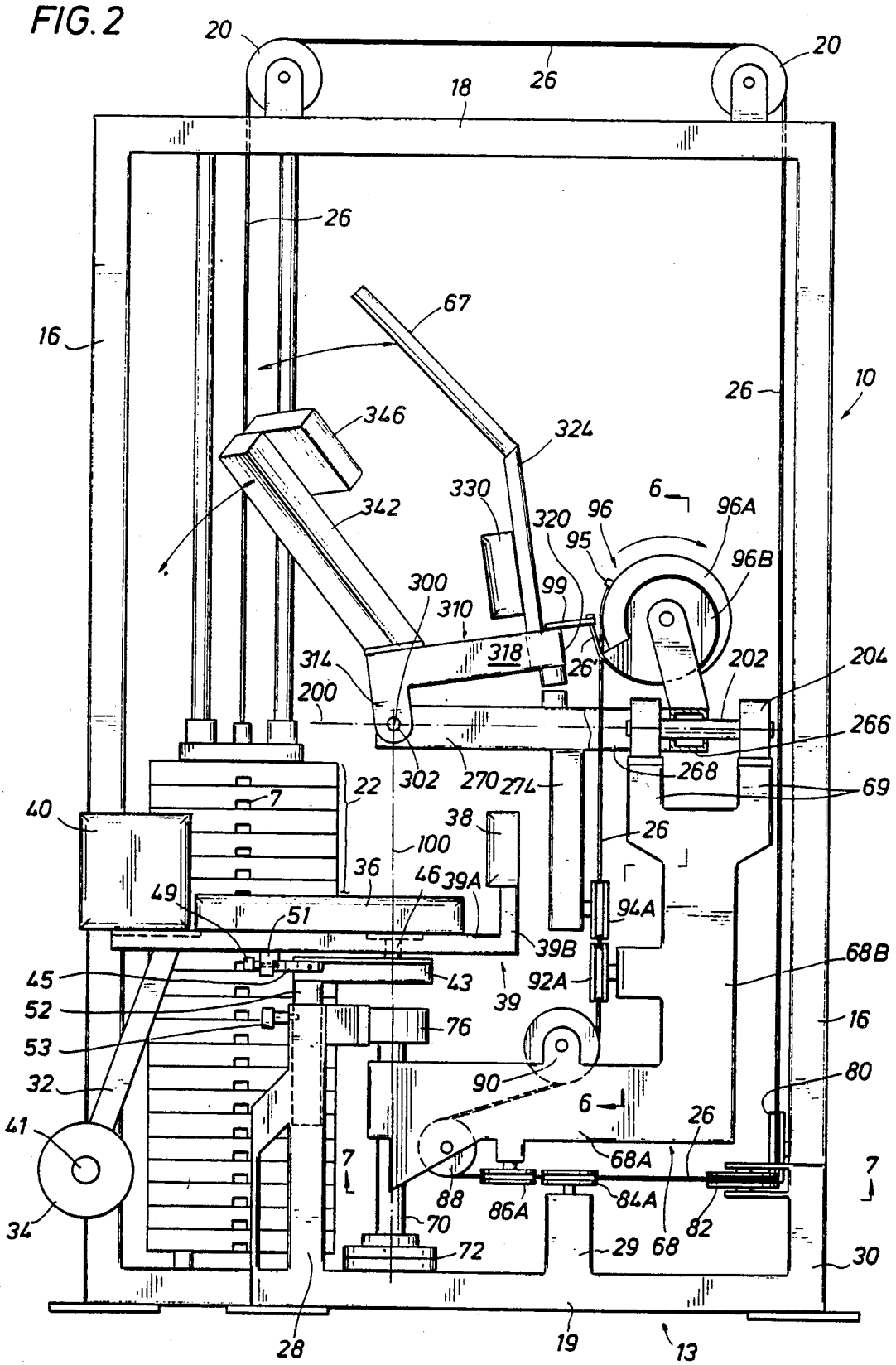
FIG. 2 is a side view of the apparatus of FIG. 1 but especially showing the upper movable or "crunch" frame which may be pivoted in a downward bending or "crunch" movement of the upper torso of a user as it rotates about a horizontal axis running from side-to-side of the user.
Figure 4:
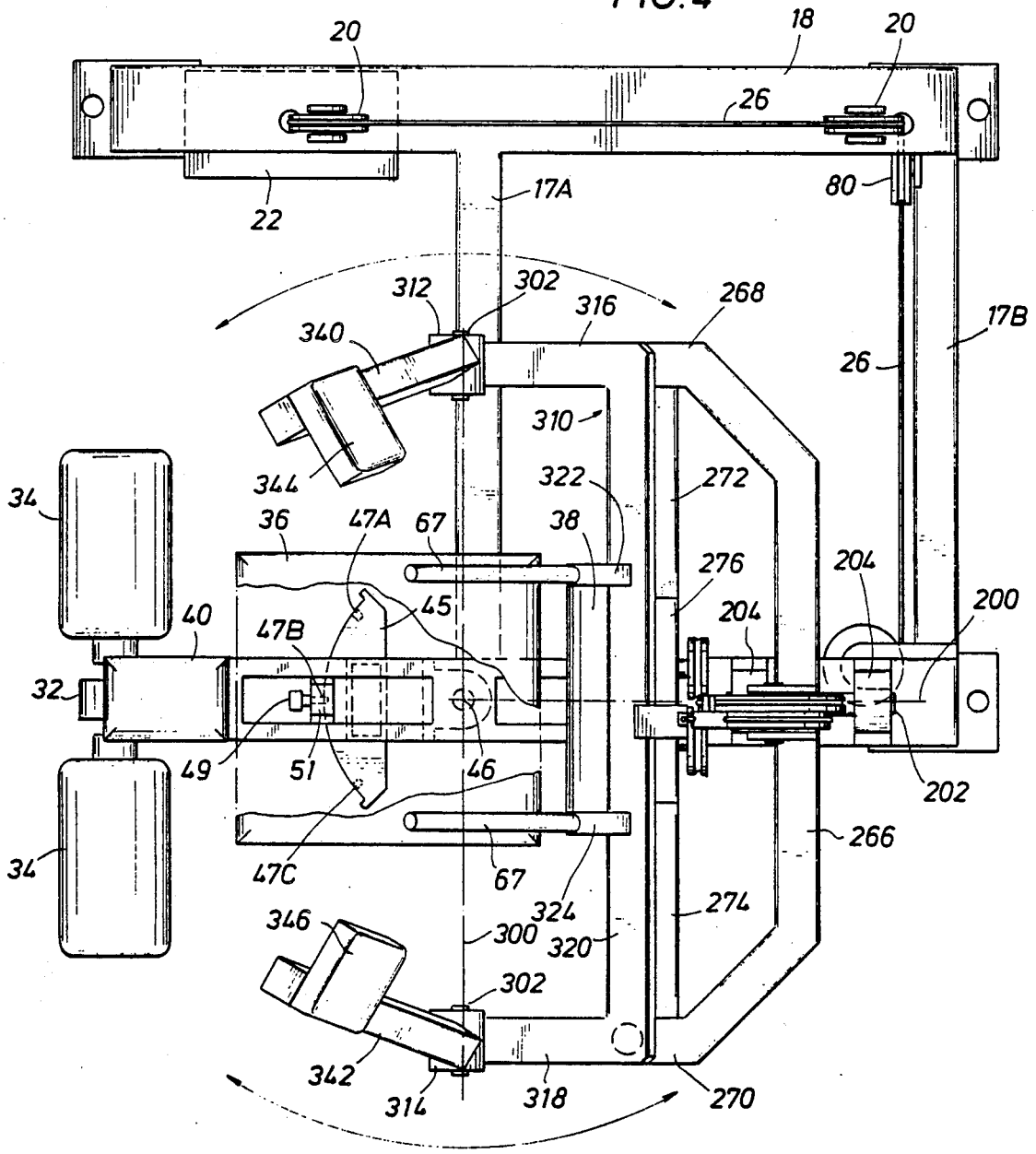
FIG. 4 is a top view of the apparatus of FIG. 1 which illustrates the use of it for rotary torso or "twisting" exercise in which the lower or "twist" frame rotates about a vertical axis that runs approximately through a seated user.

As illustrated in FIGS. 2 and 4, supporting horizontal member 39 is rotatably mounted upon sub-horizontal member 43 by means of shaft 46. Sub-horizontal member 43 carries notch plate 45 attached thereto. As best seen in FIG. 4, notch plate 45 includes three notches 47A, 47B, 47C. A spring loaded pin 49 is carried beneath horizontal member 39A by bracket 51 so that as horizontal member 39A and seat 36 are rotated on shaft 46, pin 49 may be registered with one of the notches 47A, 47B, 47C of notch plate 45. Of course, lower seat back 38, leg divider 40, support 32 and foot supports 34 rotate with seat 36 as seat 36 rotates about shaft 46. The seat 36, lower seat back 38, leg divider 40, and foot supports 34 accordingly can be oriented at a forward position, right position or left position by turning seat 36 so that pin 49 registers with a notch position 47B, 47A, and 47C.

As best seen in FIG. 2, the seat 36 height may be adjusted by means of a thumb screw 53 which bears against telescoping shaft 52 in a hollow portion of vertical member 28.

TWIST FRAME FOR ROTATION ABOUT VERTICAL AXIS

The movable components of exercise apparatus 10 are adapted to rotate about a vertical axis 100 which runs generally vertically through a person sitting astride seat 36. Such rotation results from twist frame 68 being mounted for rotation about vertical shaft 70. Accordingly a user, with his legs and feet fixed, may rotate or twist his torso about a generally vertical axis 100 through his torso. Twist frame 68 includes horizontal member 68A and vertical member 68B. Rotation of horizontal member 68A of frame member 68 is accomplished by rotatably mounting member 68A about shaft 70 in a conventional manner. Shaft 70 may rotate with respect to rotation assembly stand 13 by means of pillow blocks 76, 72 secured to vertical member 28 and horizontal member 19.

SWAY FRAME FOR ROTATION ABOUT FRONT-TO-BACK HORIZONTAL AXIS

Figure 3:
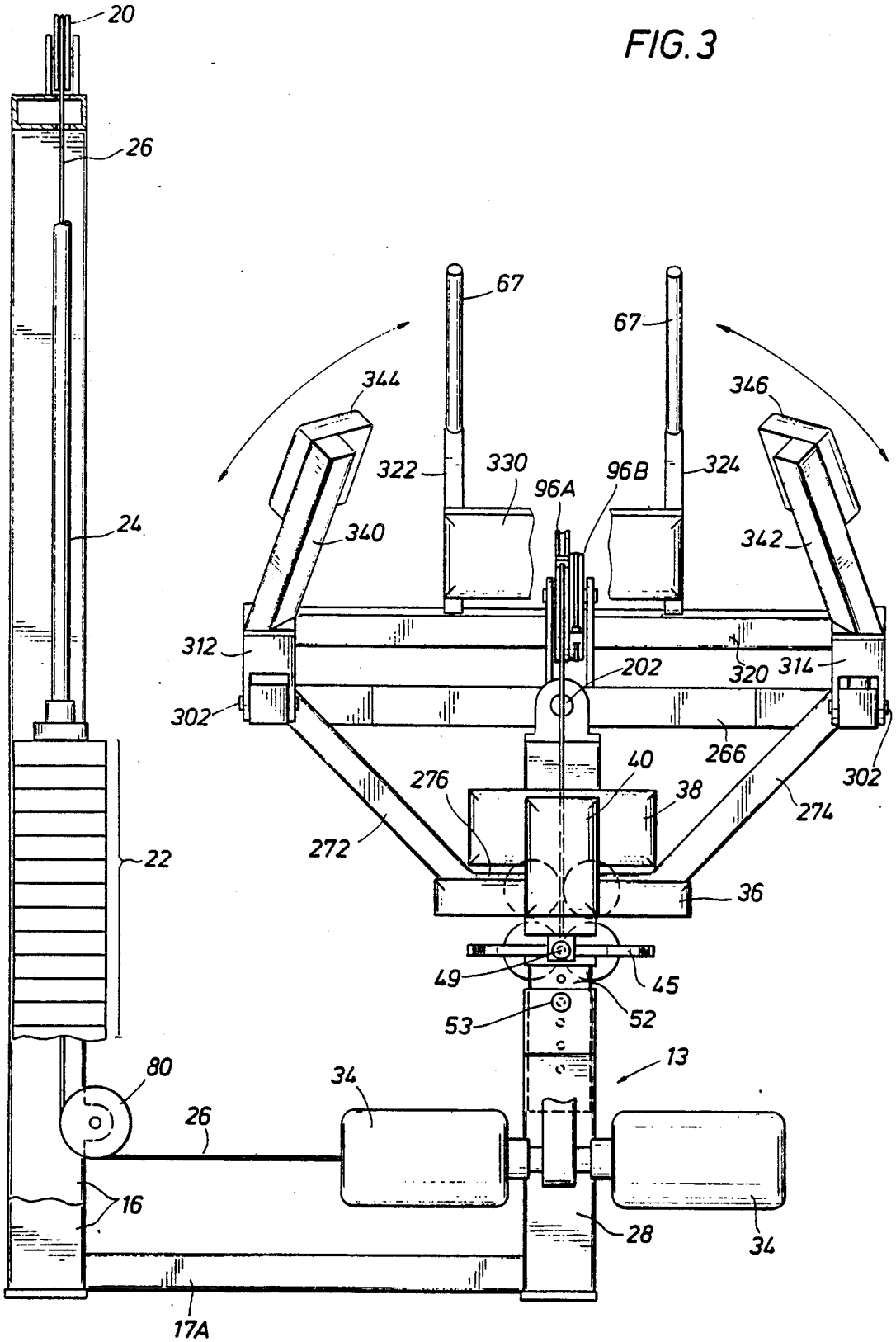
FIG. 3 is a front view of the apparatus of FIG. 1 which illustrates the use of it for side flexion or swaying exercise in which an intermediate or "sway" frame rotates about a horizontal axis that runs approximately from front-to-back of a seated user.

Certain components of exercise apparatus 10 may be rotated about a horizontal axis 200 which runs front and back through a person sitting astride seat 36. The side view of apparatus 10 of FIG. 2 and the top view of FIG. 4 illustrate front-back horizontal axis 200. Front-back horizontal axis 200 coincides with shaft 202 which is journaled within supports 204 which are secured to arms 69 of vertical member 68B of twist frame member 68. A sway frame including lateral frame member 266 is secured to shaft 202. Sway frame longitudinal frame members 268, 270 extend forward from opposite ends of lateral member 266. Sway frame diagonal members 272, 274 (FIG. 1) are connected respectively to sway frame lateral member 266 at their top ends and at their bottom ends to a sway frame lower horizontal member 276 (FIGS. 3, 4).

Accordingly a user, sitting astride seat 36 may turn frame members 266, 268, and 270 about a front-back axis 200 by rotating its attached shaft 202 with respect to twist frame vertical frame member 68B.

CRUNCH FRAME FOR ROTATION ABOUT SIDE-TO-SIDE HORIZONTAL AXIS

A crunch frame of exercise apparatus 10 may be rotated about a horizontal axis 300 as illustrated best in FIGS. 2 and 4. Side-to-side horizontal axis 300 runs through pins 302 which rotatingly secure crunch frame 310 to sway frame members 268, 270. Crunch frame 310 includes brackets 312, 314. Forward arms 316, 318 are connected to horizontal arm 320 to provide the framework for crunch frame 310.

As best seen in FIGS. 1, 2, and 3, vertical members 322, 324 extend vertically from horizontal arm 320. Back rest 330 is attached to arms 322 and 324. Hand hold members 67 angle in a forward direction from vertical members 322, 324. Angled arms 340, 342 extend upwardly at a forward and inward angle (as best seen in FIGS. 1, 3, and 4) from the outer end of forward arms 316, 318. Elbow pad members 344, 346 are attached to the end of angled arms 340, 342.

PULLEY-CABLE SYSTEM

As described briefly above weight stand 22 is connected to cable 26. As is well known in the art of exercise machine design, weight plates may be added to the end of cable 26 by placing a key in one of the slots 7 to select the number of weight plates that are appended from cable 26.

The cable is connected to the various frame members of exercise apparatus 10 via a path that includes pulleys 20 attached to horizontal frame member 18. Cable 26 runs vertically along rear vertical frame member 16 to pulley 80 which is oriented 90° from pulleys 20 so as to direct cable 26 horizontally (as best seen in FIG. 3) toward rotation stand 13. As best seen in FIGS. 1 and 2, cable 26 then runs to pulley 82 mounted on rear vertical frame member 30 and oriented 90° from pulley 80.

Figure 7:
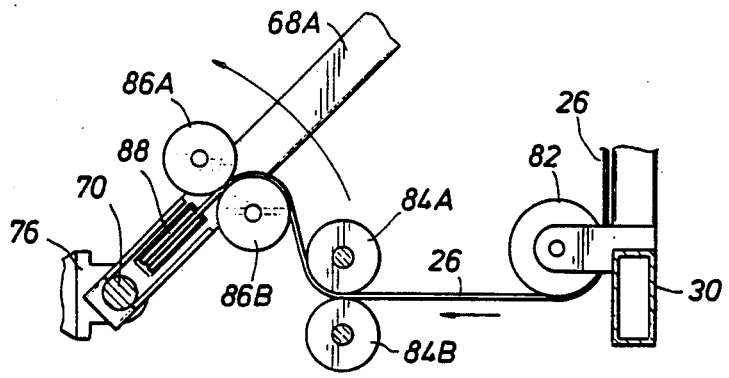
FIG. 7 is a partial view looking upward along lines 7—7 which illustrates the position of the resistance cable of the apparatus as it is being rotated about the vertical axis.

As best shown in FIGS. 2 and 7, from pulley 82, cable 26 runs forward to sheave pair 84A, 84B supported from intermediate vertical member 29. The cable 26 then runs forward to sheave pair 86A, 86B which is mounted on member 68A which is rotatable about shaft 70, that is, vertical axis 100. Next, the cable proceeds to pulley 88 mounted 90° with respect to sheave pair 86A, 86B on member 68A.

Figure 6:
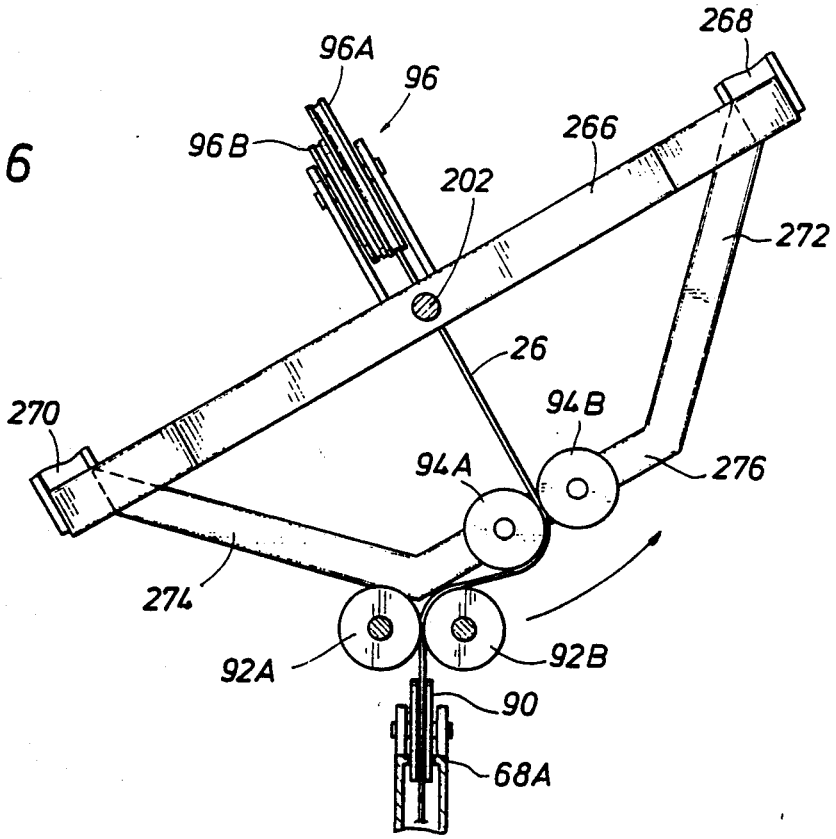
FIG. 6 is a partial view taken along lines 6—6 of FIG. 2 which illustrates the position of the resistance cable of the apparatus as it is being rotated about the horizontal axis running from front-to-back.

As best shown in FIGS. 2 and 6, the cable 26 proceeds rearwardly and upwardly to pulley 90 mounted on member 68A. Next, the cable 26 proceeds upwardly between sheave pair 92A, 92B mounted on member 68B, which is rotatable about shaft 70, and thence to sheave pair 94A, 94B mounted on lower horizontal member 276.

Figure 5:
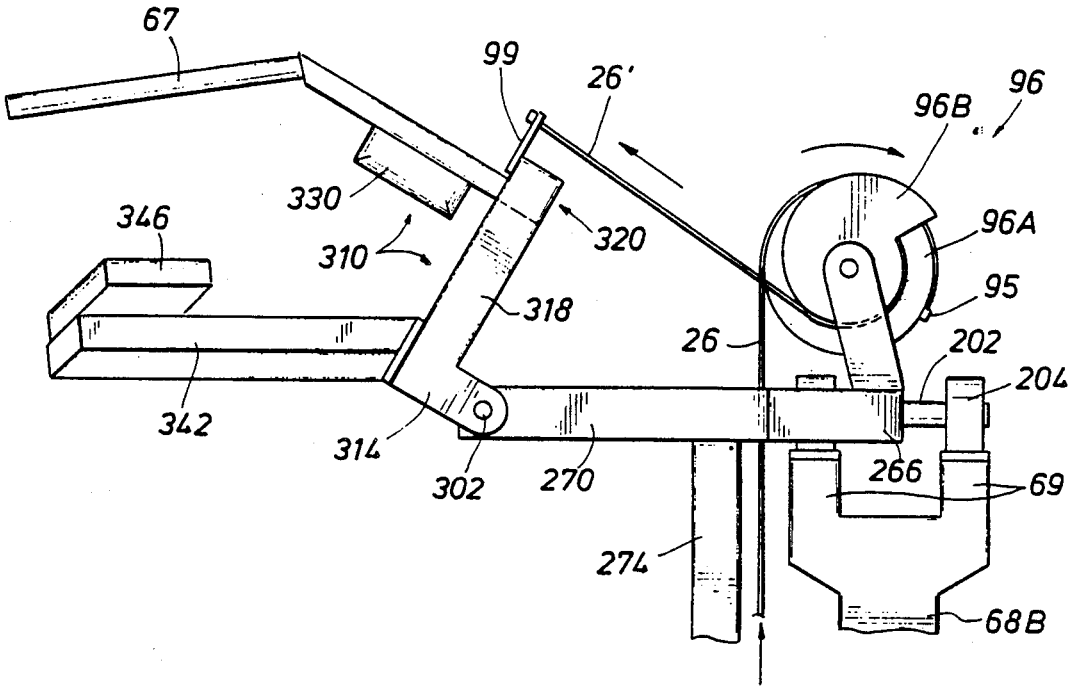
FIG. 5 is an illustration of the crunch frame rotated about its side-to-side horizontal axis with a particular illustration of a force transferring device for increasing the force necessary for the user to bend forward as the angle of forward bending increases.

Cable 26 proceeds upwardly to dual pulley 96 mounted on lateral frame member 266. Cable 26 terminates at lug 95 on the outer diameter of sheave 96A. Sheave 96B is a variable diameter sheave. A cable 26' is connected to a narrow radius section of the sheave. The cable 26' is attached to and wrapped about sheave 96B which has an increasing length radius with angular distance until it passes its greatest diameter as shown in FIG. 2. Cable 26' is secured to plate 99 which is attached to horizontal arm 320 of crunch frame 310. FIG. 5 illustrates that cable 26' passes its smallest diameter as the crunch frame 310 is rotated forward with respect to sway frame arms 268, 270.

OPERATION OF EXERCISE APPARATUS 10

As best illustrated in FIG. 1, a user of the apparatus sits on seat 36 having his knees on opposite sides of leg divider 40 and with his feet supported by foot supports 34. The user's back is supported by lower back support 38. His upper back may be supported from time to time by upper back support 330. He typically leans forward so that his elbow or shoulders rests on supports 334. He reaches upwardly and backward to grab arm handles 67. With apparatus 10, the user may rotate solely about horizontal axis 300 to achieve a "crunch" rotation so as to exercise abdominal muscles. He may also rotate about front-to-back horizontal axis 200 in a swaying motion to exercise side trunk muscles by stretching them. He may also rotate about vertical axis 100 in a twisting motion to exercise such side muscles by twisting. Of course, all combinations of two such rotations are possible. All three such motions may be accomplished also.

CRUNCH ROTATION

As best illustrated in FIGS. 2, 4, and 5, when a user leans forward to cause crunch frame 310 to rotate about axis 300 (see axis 300 in top view, FIG. 4), the crunch frame members 316, 318 rotate in a forward direction. Cable 26' is forced upwardly and forwardly causing sheave 96B to rotate in a clockwise direction. Such rotation, and the force of cable 26' is opposed by weight stack 22 acting on cable 26 connected to sheave 96A of pulley 96. Cable 26 travels from sheave 96A via sheave pairs 94A, 94B, 92A, 92B, to pulley 90, to pulley 88, to sheave pairs 86A, 86B, and 84A, 84B, to pulley 82 to pulley 80 and then to pulleys 20 and weight stack 22.

With increasing angular rotation of a user's body, the force exerted along cable 26' acts on a smaller and smaller radius of sheave 96B. In other words, with maximum angular rotation (as in FIG. 5) a smaller movement arm is applied to sheave 96B. With minimum angular rotation (as in FIG. 2) a greater movement arm is applied to sheave 96B. Accordingly, the user must exert an increasing force with angular "crunch" rotation of his body about axis 300 to counteract the constant opposing force of weight stack 22 via cable 26. Put another way, forward angular rotation about axis 300 is progressively opposed with effective resisting force as a function of angular rotation.

SWAYING ROTATION

As best illustrated in FIGS. 2 and 6, the user forces the apparatus to rotate about axis 200 to cause swaying action of sway horizontal frame member 266 and shaft 202 with respect to supports 204. By so doing, cable 26 twists as illustrated in FIG. 6 as it travels between sheave pair 94A, 94B of the sway frame and 92A, 92B of the twist frame. Sway rotation is resisted by weight stack 22 because cable 26 (as illustrated in FIG. 6) moves upwardly or lengthened with rotation of sway frame members 276, 274, 272 and 266.

TWISTING ROTATION

As best illustrated in FIGS. 2, 4, and 7, the user forces twist frame member 68A about vertical axis 100. As frame member 68A rotates about shaft 70, cable 26 is pulled from side to side as it travels between sheave pair 86A, 86B and 84A, 84B. An increase in length of travel of cable 26 as a result of such twisting is resisted by weight stack 22 on the other end of cable 26.

MULTIPLE ROTATIONS

As explained above, combinations of simultaneous crunch and sway rotations, or simultaneous crunch and twist rotation, or simultaneous sway and crunch rotations, or simultaneous sway and twist rotations, are possible with exercise apparatus 10. Simultaneous sway, crunch, and twist operation may also be achieved.

While weights actuated by a cable have been illustrated in the drawings as providing the variable resistance mechanism, it is apparent that other type of variable resistant mechanism may be utilized, such as pneumatic, hydraulic, or electromechanical mechanisms, for example, for applying a variable resistance to such movements. The present exercise apparatus simulates the freedom of the torso of a user to rotate about three distinct rotational axes. Such movements permit the conditioning and development of three separate abdominal muscle groups between the lower torso and upper torso of a user providing an exercise apparatus particularly directed to the abdominal muscle groups.

While a preferred embodiment of the present invention has been illustrated in detail, it is apparent that modifications and adaptations of the preferred embodiment will occur to those skilled in the art. For example, the machine may be constructed substantially the same except with structure so that the user is positioned on his back. However, it is to be expressly understood that such modifications and adaptations are within the spirit and scope of the present invention as set forth in the following claims.

What is claimed is:

1. Exercise apparatus for exercising torso muscles of a user's body comprising:

means for supporting the user's body including a fixed lower torso engagement means having a seat for the user and a movable upper torso engagement means extending from the seat thereon, said upper torso engagement means including a pair of pivotably connected frames, one of said frames being a lower frame mounted for rotation about an axis through said seat relative to said lower torso engagement means, and the other of said frames being an upper frame mounted for pivotal movement in a downward direction relative to said seat; and resistance means operatively connected to said upper torso engagement means for imposing force resisting the rotational and forward pivotal movements of said upper torso engagement means relative to said lower torso engagement means.

2. Exercise apparatus for exercising muscles as set forth in claim 1 wherein said upper frame has an overhead hand grip portion adapted to be gripped by the user for pulling said upper frame downwardly in the downward bending movement.

3. Exercise apparatus for exercising muscles as set forth in claim 1 wherein said lower torso engagement means has a pair of foot rests thereon and means adapted to fit between the legs of the user to restrict rotational movement of the lower torso of the user.

4. Exercise apparatus for exercising muscles as set forth in claim 1 wherein said upper torso engagement means further comprises an intermediate frame mounted between said upper and lower frames; wherein said upper and intermediate frames are supported on said movable lower frame and rotate with said lower frame upon rotational movement of said lower frame about said axis through said seat.

5. Exercise apparatus as set forth in claim 1 wherein said resistance means comprises a plurality of weights and a plurality of pulleys associated with said upper torso engagement means and said lower torso engagement means; and a cable is operatively connected to said pulleys, weights, and torso engagement means for exerting force resisting movement of said upper torso engagement means from a centered rest position.

6. Exercise apparatus for exercising torso muscles of a user's body comprising:

a fixed lower frame mounted on a supporting surface and having a seat thereon for supporting the user's body in a generally upright seated position and positioning means adapted to restrict rotational movement of the lower torso;

a crunch frame means extending upwardly from the seat and including a hand grip portion adapted to be gripped by the user;

first means mounting said cruch frame means for rotation about a generally vertical axis extending generally longitudinally along the spine of the user's body, said first mounting means including a twist frame means mounted for rotation about said vertical axis relative to said fixed frame;

second means mounting said crunch frame means for forward pivotal movement about a side-to-side horizontal axis upon pulling downwardly by the user from said hand grip portion in a downward forward movement over said seat so that said user moves downward in a downward bending movement, said second mounting means including a sway frame means connected between said crunch frame means and said twist frame means for pivoted movement relative to said twist frame means wherein said sway frame is adapted to rotate about a front-to-rear horizontal axis about said twist frame, and resistance means operatively connected to said crunch frame means for imposing force resisting rotational and pivotal movements of said movable frame means.

7. Exercise apparatus as set forth in claim 6 wherein said resistance means includes a plurality of weights and a plurality of pulleys associated with said movable frame means; and a cable is operatively connected to said pulleys and weights for exerting said force resisting movements of the upper torso of the user from a centered rest position.

8. Exercise apparatus for exercising muscles of a user's body comprising:

a fixed lower frame for the lower torso mounted on a supporting surface and having a fixed lower seat thereon for supporting the user's body in a generally upright seated position and positioning means adapted to fit between the legs of the user to restrict rotational movement of the lower torso;

a movable frame means for the upper torso extending upwardly from the seat and including a hand grip portion adapted to be gripped by the user;

said movable frame means including a pair of pivotally connected frame means, one of said frame means being a lower twist frame means for rotation about said vertical axis relative to said fixed frame, and the other of said frame means being a sway frame means pivotally connected to said twist frame means for rotation about a front-to-back horizontal axis in a swaying movement relative to said fixed seat to permit swaying of the upper torso, and resistance means operatively connected to said movable frame means for imposing force resisting twisting and swaying of the upper torso relative to the lower torso.

9. Exercise apparatus as set forth in claim 8 wherein said movable frame means further includes, a crunch frame means pivotally connected to said sway frame means for rotation about a side-to-side horizontal axis.

10. Exercise apparatus comprising:

a fixed lower frame mounted on a supporting surface having a fixed seat thereon for supporting a user's body in a generally upright seated position and positioning means for fitting between the legs of the user to restrain rotational movement of the lower torso during exercising, a lower twist frame including a generally horizontal frame member mounted for rotation about a generally vertical axis extending longitudinally of the user's body generally along the spine of the user and connected vertical frame member extending upwardly from the horizontal frame member, a sway frame mounted for rotation about a front-to-back horizontal axis on the upper end of said vertical frame member and supported by said vertical frame member, said sway frame being generally U-shaped including a pair of spaced parallel arms extending above and alongside said seat, an upper U-shaped crunch frame having extending arms pivotably connected to said arms about a side-by-side horizontal axis on said sway frame and having a back seat secured thereto including a hand grip portion, said crunch frame including said back seat and hand grip portion moving in a forward downward rotating movement about said side-by-side horizontal axis toward said fixed seat on said fixed frame when said user pulls downwardly on the hand grip portion by the user thereby moving the upper torso in a downward bending movement, said crunch frame and said sway frame moving in a lateral direction about said front-to-back horizontal axis when said user exerts a downward force against a desired arm of said crunch frame thereby causing the user's upper torso to sway relative to the user's lower torso, said crunch, sway, and twist movable frames rotating about said vertical axis of said lower movable frame upon a rotation force exerted by the user against a desired arm of said sway frame, and resistance means operatively connected to said twist, sway, and crunch frames for imposing force resisting movement of the upper torso relative to the lower torso.

11. Exercise apparatus as set forth in claim 10 wherein said lower fixed frame has a pair of foot rests disposed thereon.

12. Exercise apparatus as set forth in claim 10 wherein said hand grip portion on said upper frame comprises a pair of spaced bars extending upwardly from said back seat for gripping by said user.

13. Exercise apparatus as set forth in claim 10 wherein said resistance means comprises a plurality of weights and a plurality of pulleys associated with said movable frames; and a cable is operatively connected to said pulleys and said weights for resisting movement of the upper torso of the user from a centered rest position on said fixed seat.

14. Exercise apparatus for exercising torso muscles of a user's body comprising, stationary means for generally fixing the lower part of a user's body in a stationary position and including a seat for seating the user in a generally upright position, a lower frame mounted for rotation about a vertical axis through said seat, crunch frame means mounted with respect to said lower frame for user induced rotation about a side-to-side horizontal axis with respect to said lower frame while said user is seated on said seat, and a two sheave pulley means including a first sheave having a constant radius cable groove and a second sheave having a variable radius cable groove, a first cable fixed at one end via a pulley system to a weight and at its other end to said first sheave of said two sheave pulley, and a second cable fixed at one end to said crunch frame means and at its other end to said second sheave, whereby increasing rotation force with increasing rotation angle of said crunch frame is required by said user to rotate said crunch frame means.

15. Exercise apparatus comprising a fixed lower frame, a lower twist frame mounted for rotation about a vertical axis of said fixed lower frame, a sway frame pivotally mounted to said lower twist frame for rotation about a front-to-back horizontal axis, a weight stack, and a cable and pulley arrangement including a single cable running from said lower twist frame and said sway frame to said weight stack, whereby twisting motion about said vertical axis and swaying motion about said front-to-back horizontal axis are individually or simultaneously impeded by said weight stack.

16. The apparatus of claim 15 further including an upper crunch frame pivotally mounted to said sway frame for rotation about a side-by-side horizontal axis, and said cable and pulley arrangement further includes a two sheave pulley mounted on said sway frame, said two sheave pulley including a first sheave having a constant radius cable groove and a second sheave having a variable radius cable groove, said single cable fixed at its end opposite said weight stack to said first sheave, and a second cable fixed at one end to said cruch frame means and at its other end to said second sheave, whereby crunching motion about said side-by-side horizontal axis is impeded by said weight stack either individually or simultaneously with swaying motion about said front-to-back horizontal axis or twisting motion about said vertical axis.

* * * * *